US005668448A

United States Patent [19]

Montie et al.

[11] Patent Number: 5,668,448

[45] Date of Patent: Sep. 16, 1997

[54] PICTURE DISPLAY DEVICE PROVIDED WITH AN ELECTRON GUN, AND ELECTRON GUN FOR USE IN SUCH A DEVICE

[75] Inventors: Edwin A. Montie; Alfred Ketting; Ronald Van Der Wilk, all of Eindhoven, Netherlands

[73] Assignee: U.S. Philips Corporation, New York, N.Y.

[21] Appl. No.: 518,060

[22] Filed: Aug. 22, 1995

[30] Foreign Application Priority Data

Aug. 25, 1994 [EP] European Pat. Off. ..... 94202434

[51] Int. Cl.[6] ..... H01J 29/58

[52] U.S. Cl. ..... 315/382.1; 315/15; 313/414

[58] Field of Search ..... 315/14, 15, 16, 315/382, 382.1; 313/414, 449

[56] References Cited

U.S. PATENT DOCUMENTS 3,932,786 1/1976 Campbell .
4,218,634 8/1980 Takenaka .
5,383,088 1/1995 Chapple-Sokol et al. ..... 361/305
5,449,983 9/1995 Sugawara et al. ..... 315/382

*Primary Examiner*—Theodore M. Blum
*Attorney, Agent, or Firm*—Robert J. Kraus

[57] ABSTRACT

A picture display device comprises an evacuated envelope and is provided at a first side with an electroluminescent display screen and at an opposite side with an electron gun (6). Between the electron gun (6) and the display screen, the device comprises deflection means with which an electron beam generated by the electron gun (6) can be deflected during operation. The electron gun (6) has at least an electron beam-generating portion (20) and is provided with a main lens system (40) having a first electrode (41), a final electrode (45) and at least one intermediate electrode (42–44) across which a main lens voltage is gradually applied step-wise during operation so as to form an electron-optical main focusing lens. The gun is further provided with means for presenting a dynamic potential ($V_d$) to at least an electrode (41) of the main lens system (40), which is the first electrode viewed in the direction of propagation of the electron beam (7–9). For an increased dynamic focusing, a coupling capacitor (50) is arranged at least between said first electrode (41) and the subsequent electrode (42) of the main lens system (40).

6 Claims, 3 Drawing Sheets

PICTURE DISPLAY DEVICE PROVIDED WITH AN ELECTRON GUN, AND ELECTRON GUN FOR USE IN SUCH A DEVICE

BACKGROUND OF THE INVENTION

The invention relates to a picture display device comprising an evacuated envelope, a first side of which is provided with an electroluminescent display screen, an opposite side is provided with an electron gun and in which deflection means are arranged between the electron gun and the display screen with which means, at least during operation, an electron beam generated by the electron gun can be deflected, the electron gun having a portion generating at least an electron beam and being provided with a main lens system having a first electrode, a final electrode and at least one intermediate electrode across which a main lens voltage is gradually applied step-wise during operation so as to form an electron-optical main focusing lens. The invention also relates to an electron gun for use in such a device.

Such a device is known from U.S. Pat. No. 3,932,786. The electron gun described in this Patent comprises six intermediate electrodes between the first electrode and the final electrode of the main lens system and, in comparison with other, more conventional electron guns, it comprises a relatively large number of electrodes. For this reason such a main lens is commonly referred to as DML (Distributed Main Lens), MSFL (Multi-Stage Focus Lens) or MEL (Multi-Element Lens). The separate electrodes of the main lens system in the known device are interconnected by means of a resistive voltage divider so that the main lens voltage is gradually distributed step-wise across the electrodes during operation in order to reduce the magnitude of potential jumps in the main lens system. This leads to considerably improved lens properties as compared with more conventional guns in which the main lens voltage is entirely applied across only two electrodes. Notably spherical aberrations can be adequately suppressed to relatively large electron beam currents without an increase of the lens diameter being required.

Although spherical aberrations can be reduced to an acceptable level in a picture display device of the type described above, spot errors may nevertheless occur due to dynamic focusing errors. Such spot errors arise, inter alia because the path length of the electron beam varies, dependent on the position of the spot on the display screen. This becomes notably manifest with pixels which are further remote from the centre of the display screen.

SUMMARY OF THE INVENTION

It is, inter alia an object of the present invention to provide a picture display device of the type described in the opening paragraph in which also dynamic focusing errors are adequately inhibited.

According to the invention, a device of the type described in the opening paragraph is therefore characterized in that the first electrode of the main lens system is provided with means for applying a dynamic potential thereto, at least during operation, and in that a coupling capacitor is arranged at least between the first electrode and the electrode of the main lens system which is the subsequent electrode viewed in the direction of propagation of the electron beam.

The dynamic voltage which is applied to the first electrode of the main lens system in the device according to the invention has a time-dependent variation which is adapted to the sweep of the electron beam across the display screen.

With this dynamic signal, the static main lens voltage is constantly corrected for the changing path length of the beam. Thus it is achieved that a voltage which is always optimum for focusing the beam is present across the main lens system. The invention is based on the recognition that such a dynamic focusing is considerably increased by coupling the dynamic potential via a coupling capacitor to at least the electrode subsequent to the first electrode of the system. According to the invention, an extremely accurate spot formation is achieved in a device of the type described in the opening paragraph.

A special embodiment of the device according to the invention is characterized in that a coupling capacitor is arranged both between the first electrode of the main lens system and the subsequent electrode of the system, and between said subsequent electrode and the next electrode of the system. In this embodiment the dynamic focusing is further increased because a coupling capacitor is now arranged not only between the first electrode and the subsequent electrode of the main lens system but also between said subsequent electrode and the next electrode of the system. Coupling capacitors may also be arranged between further pairs of adjacent electrodes of the system so as to further spread the dynamic potential across the main lens system. A better dynamic focusing and consequently a better lens action always appears to be achieved as compared with the full absence of coupling capacitors in the main lens system. The plurality of coupling capacitors may each have the same capacitance or be separately adjusted to a lens action which is optimum for specific cases.

As a larger number of coupling capacitors is used in the main lens system, the dynamic potential has a larger spread across the electrodes of the grid so that the electron beam will be subject to fewer large potential jumps. The dynamic effect of the main lens system thereby decreases eventually. An optimum dynamic lens action is achieved in a preferred embodiment of the device according to the invention in which a coupling capacitor is arranged exclusively between the first electrode of the main lens system and the subsequent electrode of the system, and between the subsequent electrode and the next electrode of the system. In this embodiment a coupling capacitor is arranged exclusively between the first two pairs of adjacent electrodes of the main lens system.

Exclusively capacitors resistant to the potential differences which are customary in electron guns should be used as coupling capacitors. In a special embodiment of the device according to the invention only capacitors having a dielectric of barium titanium oxide and being resistant to potential differences of up to about 15 kV are used.

BRIEF DESCRIPTION OF THE DRAWING

These and other aspects of the invention will be apparent from and elucidated with reference to the embodiments described hereinafter.

In the drawings.

The Figures are purely diagrammatic and not to scale. For the sake of clarity, some dimensions are exaggerated. Corresponding components in the Figures have been given identical reference numerals as much as possible.

DESCRIPTION OF THE PREFERRED EMBODIMENTS

Figure 1:
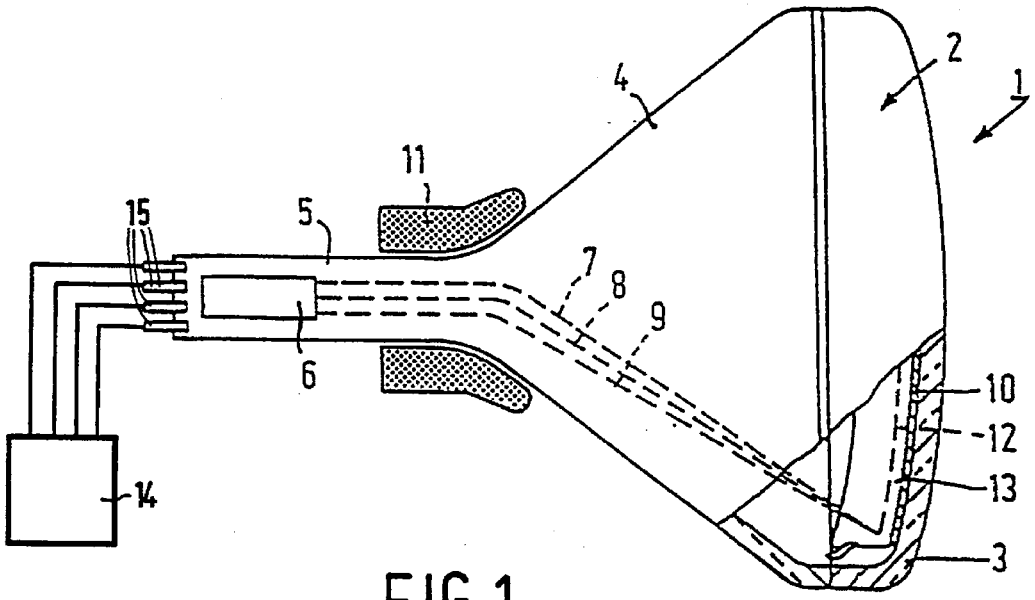
FIG. 1 shows an embodiment of the picture display device according to the invention.

The embodiment of the picture display device according to the invention shown in FIG. 1 is provided with a cathode ray tube 1 having an evacuated envelope 2 with a display window 3, a cone 4 and a neck 5. The neck 5 accommodates an electron gun 6 for generating, in this embodiment, three electron beams 7–9. It is to be noted that within the scope of the invention the term electron gun should be considered to have a wide meaning so that it does not only include a single gun suitable for generating only one electron beam, but also integrated or non-integrated systems of often three electron guns which are described, for example in the present embodiment.

An electroluminescent display screen 10 which, in this embodiment comprises red, green and blue phosphor elements is present at the inner side of the display window 3. The outer side of the envelope 2 is provided with deflection means 11 which are only shown diagrammatically and generally comprise a deflection unit in the form of a system of magnetic coils. On their path to the display screen 10, the electron beams 7–9 can be deflected by means of the deflection unit so that the entire display screen 10 can be scanned, and the beams pass a colour selection means 12 which in this embodiment comprises a shadow mask in the form of a plate having apertures 13. The beams 7–9 pass the apertures 13 at a small mutual angle and thus only impinge on phosphor elements of the colour associated with the relevant beam 7, 8, 9. The picture display device further comprises means 14, shown diagrammatically, for applying electric voltages to the electrodes of the electron gun, which means are connected to the electron gun 6 in the final product by means of lead-through electrodes 15. The assembly further has a housing (not shown). Particularly, means 14 may be used for applying a dynamic potential to the main lens system.

Figure 2:
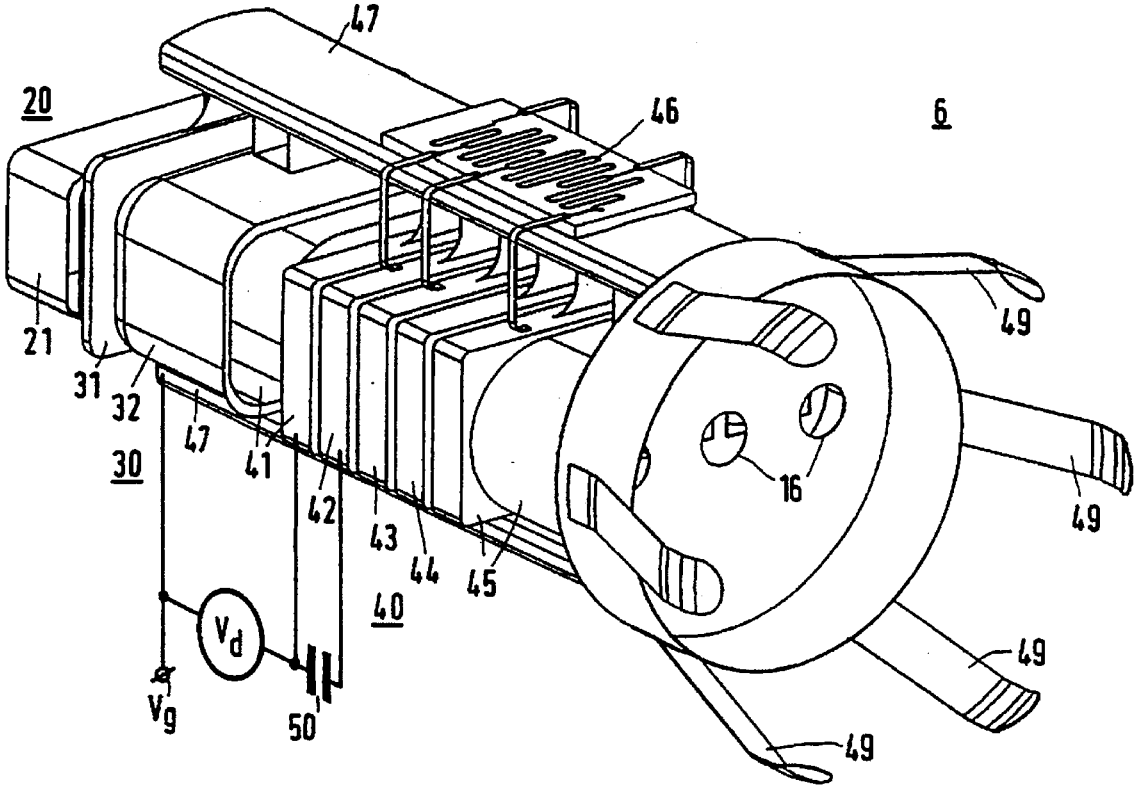
FIG. 2 shows in a perspective and larger view the structure of the electron gun of the picture display device of FIG. 1.
Figure 3A:
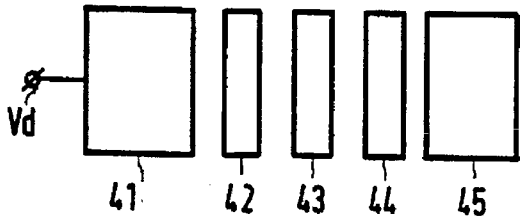
FIG. 3A–3F are a diagrammatic representation of various embodiments with an internal capacitive coupling of the main lens system of the electron gun of FIG. 2.
Figure 3B:
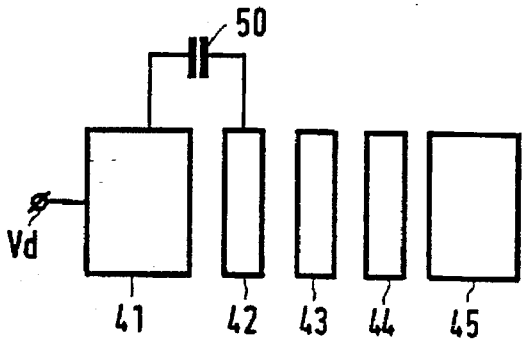
Figure 3C:
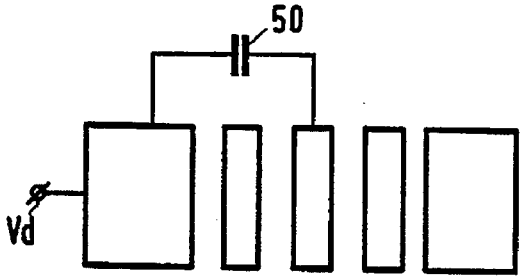
Figure 3D:
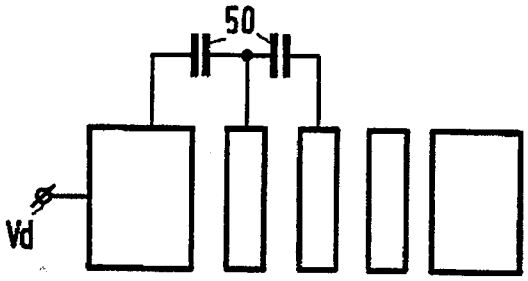
Figure 3E:
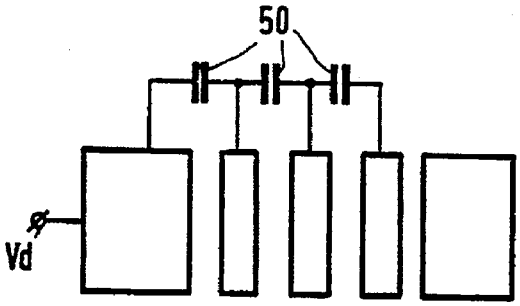
Figure 3F:
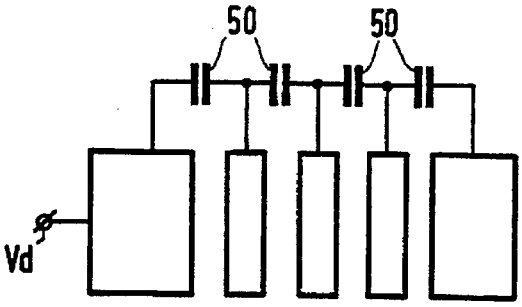

The electron gun 6 of the device of FIG. 1 is shown in perspective and greater detail in FIG. 2. The gun 6 comprises an electron beam-generating portion 20 referred to as the triode, in which three juxtaposed electron sources are incorporated which are provided with a common electrode 21, often referred to as G1 which is connected to ground during operation. Similarly as all other electrodes of the electron gun 6, the common electrode 21 is provided with three apertures 16 aligned in a row and having a diameter of approximately 5.5 mm for passing the electron beams.

The gun 6 also comprises a prefocusing section 30 which is constituted by two successive electrodes 31, 32 having operating potentials of typically 400–500 volts and 5–6 kV, respectively which are usually denoted as G2 and G3, respectively. The electron-optical prefocusing lens which is constituted by this system 31, 32 of electrodes provides a virtual image of the electron sources which serves as an object for a main focusing lens constituted in a subsequent main focusing section of the gun.

The main focusing section comprises a main lens system 40 having a first electrode (41), a final electrode (45) and three intermediate electrodes (42–44) across which a main lens voltage of typically 25–30 kV is applied during operation. In this embodiment, a potential $V_g$ of 5–6 kV is present during operation at a first electrode 41 of the system, while the potential of the last electrode 45 which is generally referred to as anode is 30–35 kV during operation.

In the main lens system of the device described, the main lens voltage is distributed gradually and step-wise across the five electrodes (41–45) of the main lens system (40). To this end the intermediate electrodes 42–44 are interconnected by means of a resistive voltage divider 46 and connected to the outer electrodes 41, 45 of the system. By this uniform and step-wise spread of the main lens voltage across the five electrodes, the potential jump between adjacent electrodes in the main lens system may remain limited to 5–15 kV, which has an extremely favourable effect on the lens action of the main lens. Thus, for example spherical aberrations can be adequately inhibited, even at larger beam currents without an increase of the lens diameter being required.

The different components of the gun are held together at both sides by means of an insulating support 47, often referred to as multiform rod or beading rod and fixed with respect to each other. The assembly further comprises a plurality of radially positioned centring springs 49 with which the gun is centred in the neck 5 of the envelope 2 and with which also the high voltage of the anode 45 can be taken up at the tube wall. At the opposite side, the gun is provided with lead-through electrodes 15 which for the sake of clarity have been omitted in the relevant Figure, but with which the other potentials required in the gun can be supplied.

The first electrode 41 of the main lens system 40 is provided with means in the form of an electric connection shown diagrammatically in the Figure for applying, during operation a dynamic potential $V_d$ of the order of 0.5–2.0 kV in addition to a static potential $V_g$ of 5–6 kV to these means. The time-dependent variation of the dynamic voltage $V_d$ follows the sweep of the electron beam 7, 8, 9 in the deflection field of the deflection means 11 in such a way that the total focusing voltage is always adapted to the changing path length of the beam. Thus, in the device according to the invention, dynamic focus errors and related spherical aberrations of the ultimate spot of the beam 7, 8, 9 on the display screen 10 can be inhibited.

According to the invention, the dynamic voltage $V_d$ is also applied to at least the subsequent electrode 42 of the main lens system 40. This is achieved by arranging a coupling capacitor 50 at least between the first electrode 41 and the subsequent electrode 42. The coupling capacitor is not visible in FIG. 2 but is represented diagrammatically.

FIG. 3 shows diagrammatically a plurality of alternative configurations of the main lens system of the gun of FIG. 2 with one or more coupling capacitors 50 between adjacent grids. Moreover, the known situation is shown in which there is no coupling capacitor between the grids but only a small parasitic coupling. In this embodiment a capacitor having a dielectric of barium titanium oxide which is breakdown-resistant to high voltages of up to about 15 kV is used for the coupling capacitor(s) (50). Moreover, in this embodiment substantially identical capacitors 50 having a relatively large capacitance of approximately 2 nF are used. Within the scope of the invention it is readily possible to vary the capacitances of the different coupling capacitors 50 in the system 40 so as to further improve the dynamic focusing and use smaller capacitances which, however, should exceed the value of the parasitic capacitance of typically 3–50 pF.

Figure 4:
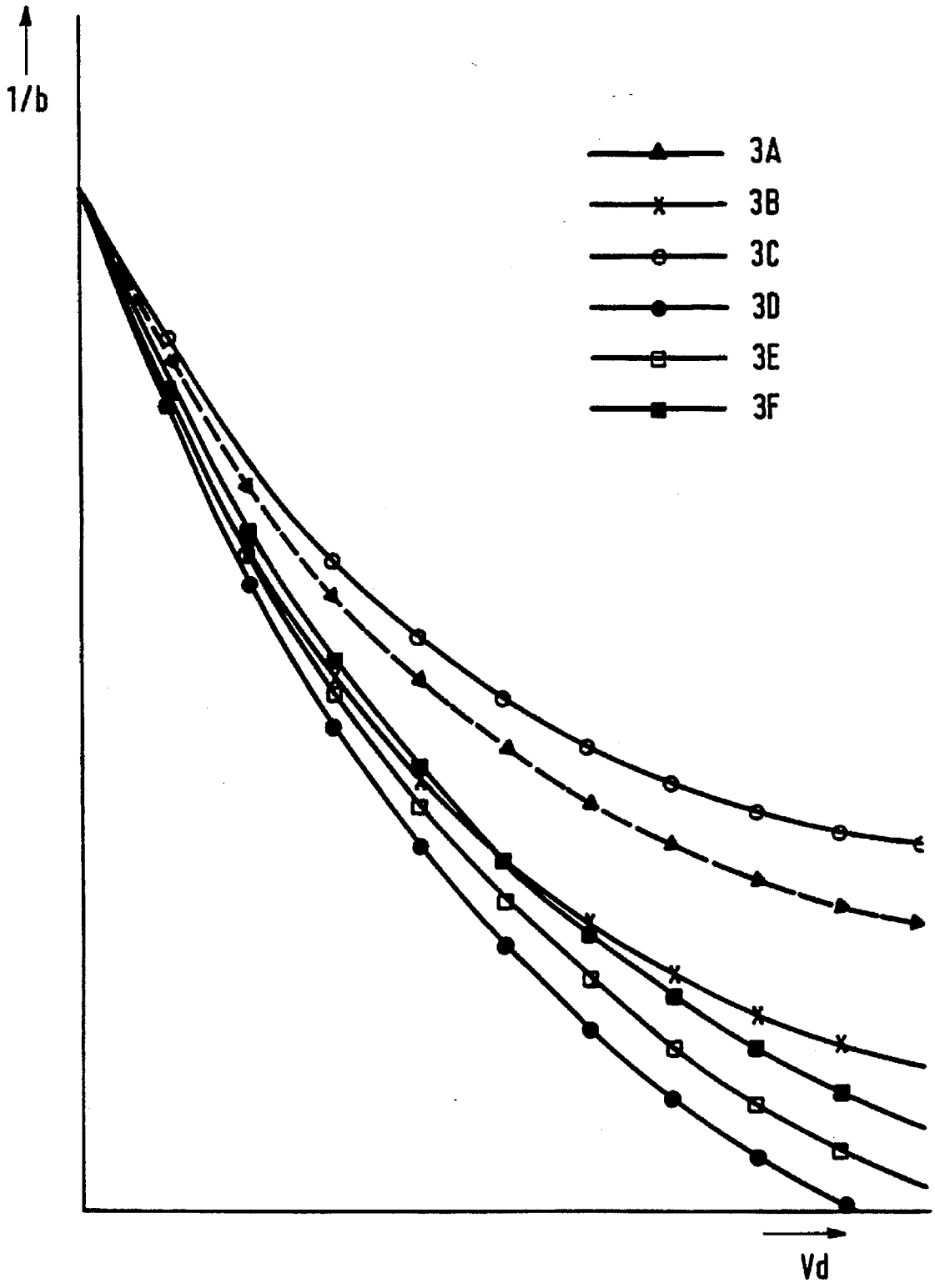
FIG. 4 shows a computer simulation of the dynamic lens action of the main lens system in accordance with the different embodiments shown in FIG. 3.

Of the different configurations of FIG. 3, FIG. 4 shows a computer simulation of the dynamic focusing across the display screen in terms of the reciprocal value of the focal length 1/b as a function of the dynamic focusing voltage $V_d$. The curve indications correspond to the numbers of the configurations in FIG. 3. All configurations 3B, 3D–F in which, in accordance with the invention, a coupling capacitor is arranged between the first electrode 41 and the subsequent electrode 42 of the main lens system appear to have a stronger dynamic focusing than the reference system 3A in which no coupling capacitor are used. A further improvement of the dynamic focusing is obtained in all configurations 3D–F in which a coupling capacitor 50 is arranged both between the first electrode 41 of the main lens system 40 and the subsequent electrode 42 of the system, and between said subsequent electrode 42 and the next electrode 43 of the system, and possibly between further pairs 43–44, 44–45 of electrodes. In contrast, the coupling between the first electrode 41 of the system and only the third electrode 43, cf. configuration 3C, provides a poorer dynamic focusing than the reference system 3A.

Moreover, it appears that configuration 3D is preferred in which the dynamic focusing voltage is coupled through in the main lens system 40 but still not "spread" so much that its effect becomes smaller. This configuration shows the strongest dynamic focusing and is therefore used in a preferred embodiment of the invention.

Although the invention has been described with reference to a single embodiment, it will be evident that it is by no means limited thereto and that those skilled in the art will be able to conceive many variations and designs within the scope of the invention. For example, the invention is not only suitable for a gun of the above-described bipotential type but also for unipotential and three-potential guns in which a potential is associated with at least one of the electrodes of the main lens system. Moreover, within the scope of the invention, a larger or smaller number than three electrodes can be used between the first and last electrodes of the main lens system. Moreover, the invention is not only suitable for a colour display device having an integrated colour gun but also for a colour display device having (three) separate electron guns, and for monochrome picture display devices.

Generally, the invention provides a picture display device of the type described in the opening paragraph with an electron gun comprising a multiple main lens in which in comparison with conventional devices of the same type a considerably better focusing is achieved by presenting a dynamic focusing voltage and by capacitive intercoupling of adjacent electrodes.

We claim:

1. A picture display device comprising an envelope containing a luminescent screen and an electron gun for producing at least one deflectable electron beam for propagation to the screen, said electron gun including a main lens system for variably focusing said at least one electron beam as it is deflected across the screen, said main lens system including:

a. an arrangement of successive electrodes having respective apertures for passing the at least one electron beam, said electrodes including, in the direction of electron beam propagation:
   (i) a first electrode;
   (ii) at least one intermediate electrode, preceded by the first electrode;
   (iii) a final electrode, subsequent to the at least one intermediate electrode;

b. voltage distribution means electrically connected to the arrangement of successive electrodes for, upon the application of a first voltage to the first electrode and a final voltage to the final electrode, effecting the application of an intermediate voltage to each of the at least one intermediate electrodes, each said intermediate voltage being intermediate and substantially different from said voltages applied to the immediately-preceding and the immediately-subsequent electrodes;

c. means for applying a dynamic potential to the first electrode;

d. a first coupling capacitor electrically connecting the first electrode and a first intermediate electrode.

2. A picture display device as in claim 1 including a second coupling capacitor electrically connecting the first intermediate electrode and an immediately-subsequent second intermediate electrode.

3. A picture display device as in claim 2 comprising at least a final one of the intermediate electrodes that is not electrically connected via a coupling capacitor to any preceding one of the intermediate electrodes.

4. A picture display device as in claim 3 comprising three intermediate electrodes.

5. A picture display device as in claim 1, 2 or 3 where each of the coupling capacitors comprises a dielectric consisting essentially of barium titanium oxide.

6. A picture display device as in claim 1, 2 or 3 where each of the coupling capacitors has a capacitance which is substantially larger than parasitic capacitance already existing between the electrodes that are electrically connected by the respective coupling capacitor.

* * * * *